United States Patent [19]

Albert

[11] 4,424,595

[45] Jan. 10, 1984

[54] BOXING GLOVE

[76] Inventor: Howard Albert, 27 Eaton Rd., Syosset, N.Y. 11791

[21] Appl. No.: 320,596

[22] Filed: Nov. 12, 1981

[51] Int. Cl.[3] ..... A41D 13/10

[52] U.S. Cl. ..... 2/18

[58] Field of Search ..... 2/18, 158, 161 A, 16, 2/17

[56] References Cited

U.S. PATENT DOCUMENTS

| | | | |
|---|---|---|---|
| 421,447 | 2/1890 | Stewart | 2/18 |
| 1,146,742 | 7/1915 | Stillman | 2/18 |
| 1,150,648 | 8/1915 | Travers | 2/18 |
| 1,188,710 | 6/1916 | Westerman | 2/18 |
| 1,360,840 | 11/1920 | White | 2/16 |
| 1,534,906 | 4/1925 | Bridgewater | 2/18 |
| 2,284,300 | 5/1942 | Portal | 2/18 |
| 2,416,444 | 2/1947 | Hilton | 2/18 |
| 2,556,759 | 6/1951 | Hilton | 2/18 |
| 2,740,120 | 4/1956 | Temple | 2/18 |
| 3,217,333 | 11/1965 | Sweet el al. | 2/18 |
| 3,540,059 | 11/1970 | Kennedy | 2/18 |
| 3,755,820 | 9/1973 | Petrusek | 2/18 |
| 3,945,045 | 3/1976 | Rhee | 2/16 |
| 4,095,294 | 6/1978 | Winterbottom | 2/18 |

FOREIGN PATENT DOCUMENTS

| | | | |
|---|---|---|---|
| 401714 | 9/1924 | Fed. Rep. of Germany . | |
| 1516 | of 1885 | United Kingdom | 2/18 |

*Primary Examiner*—Louis Rimrodi

*Attorney, Agent, or Firm*—Hosier, Niro & Daleiden, Ltd.

[57] ABSTRACT

A thumbless boxing glove is disclosed with a mitt section defined by a soft padded back portion and a palm portion. The back portion and palm portion define an inner cavity for receiving the entire hand of a boxer. A flexible strap is secured within the inner cavity for restricting movement of a boxer's thumb to a position for proper clenching about the boxer's fist. The palm portion is cut away to provide a longitudinally extending opening therein. Lacings bridge the opening and connect the margins thereof for tightening the glove about the boxer's hand. The lacings are secured to the soft padded back portion at a point beyond the palm portion to draw the back portion into a fist conformation upon tightening the lacings.

12 Claims, 9 Drawing Figures

BOXING GLOVE

BACKGROUND OF THE INVENTION

This invention relates generally to boxing gloves that are safer than conventional boxing gloves now in use, and which provide better protection both for the wearer and his opponent.

Most conventional boxing gloves are constructed generally like a mitten with a separate inner pocket for the palm of a boxer's hand and with an attached thumb portion extending from the palm of the glove. The thumb portion of the glove presents a source of danger to both contestants and is a continuing problem in both professional and amateur boxing contests. Because the thumb may be moved away from the mitt or back portion of the glove, there constantly is a risk of dislocation or more serious injury to the wearer's thumb by snagging or striking a part of his opponent's body. This causes the thumb to be twisted or bent back resulting in injury to the thumb of the boxer, particularly with bulky thumb portions of conventional boxing gloves.

The separate glove thumb also permits a boxer to avail himself of an unfair and illegal opportunity of thumb-gouging an opponent's eye or other part of the face, particularly with glancing blows. The separate glove thumb also facilitates objectionable holding or clenching tactics.

Various attempts have been made to provide a thumbless boxing glove, including the patented art. Although prior thumbless boxing gloves are effective in eliminating the bulky thumb portion which could cause injury to an opponent, prior thumbless gloves still permit too much flexibility of the wearer's thumb particularly in the area of the inner or second joint thereof. The thumb still can move outwardly of the remaining fingers of the hand and cause dislocation and other serious injury.

Another yet similar problem concerns the use of the padded extremity of a boxing glove unfairly and illegally against an opponent by a tactic commonly called "palming." Conventional boxing gloves normally have a soft padded back portion and a palm portion. The padded back portion is curved around the end of the boxing glove toward the palm portion, resulting in a projection which can cause injury to an opponent similar to that of the projecting thumb portion. It would be desirable to provide a boxing glove which not only provides sufficient padded protection for the wearer about the forward extremity of the glove, but which would prevent the glove from being opened sufficiently to use the forward, inner padded projection thereof unfairly and illegally against an opponent. This also would reduce objectionable holding or clenching tactics.

The present invention is directed to solving the above and similar problems of conventional boxing gloves now in use.

SUMMARY OF THE INVENTION

Accordingly, an object of the present invention is to provide a new and improved boxing glove which provides more protection for both the wearer and his opponent in boxing contests.

In the exemplary embodiment of the invention, a thumbless boxing glove is provided with a mitt section defined by a soft padded back portion and a palm portion. The back and palm portions define an inner cavity for receiving the entire hand of a boxer. Means is provided within the inner cavity for restricting movement of a boxer's thumb to a position for proper clenching about the boxer's fist. However, the thumb movement restricting means prevents the thumb from moving outwardly from the remaining fingers of the hand and more serious injury to the thumb.

In the preferred embodiment of the invention, the thumb movement restricting means comprises a flexible strap for embracing the boxer's thumb generally in the area of the inner or second joint of the thumb. The strap is secured at opposite ends thereof to the inside of the palm portion of the glove. The illustrated thumbless boxing glove includes an elongated hand grip member extending across the interior of the inner cavity of the glove generally parallel to the palm portion and in position to be substantially enclosed by a closed fist of the boxer. The thumb restricting strap is positioned within the cavity at one end of the hand grip member whereby the boxer's thumb can be positioned for proper clenching about the remaining fingers of the hand which are closed about the hand grip member.

Another important feature of the invention is the provision of means for drawing the back portion of the glove into a fist conformation and thereby prevent utilization of the back portion which projects beyond the palm portion to an unfair advantage over an opponent. More particularly, the palm portion is cut away to provide a longitudinally extending opening. Lacings bridge the cut away opening and connect the margins thereof for tightening the glove about a boxer's hand. Means is provided for securing the lacings to the soft padded back portion at a point beyond the palm portion to draw the back portion into a fist conformation upon tightening the lacings. This conformation of the glove prevents the glove from being "opened" by a boxer until the lacings are loosened.

In the exemplary embodiment of the invention, the lacings comprise a single lace string for connecting the margins of the cut away opening in the palm portion of the glove. A loop is secured on the outside of the padded back portion of the glove slightly beyond the palm portion of the glove. A pair of apertures are formed in the palm portion beyond the end of the cut away opening and through which the lacings can pass from the inner cavity of the glove for threading through the loop. Thus, as the lacings are gathered for tightening the glove about the boxer's hand, the lacings will pull on the loop which is secured to the back portion and draw the soft padded back portion into a fist conformation as the lacings are tightened.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
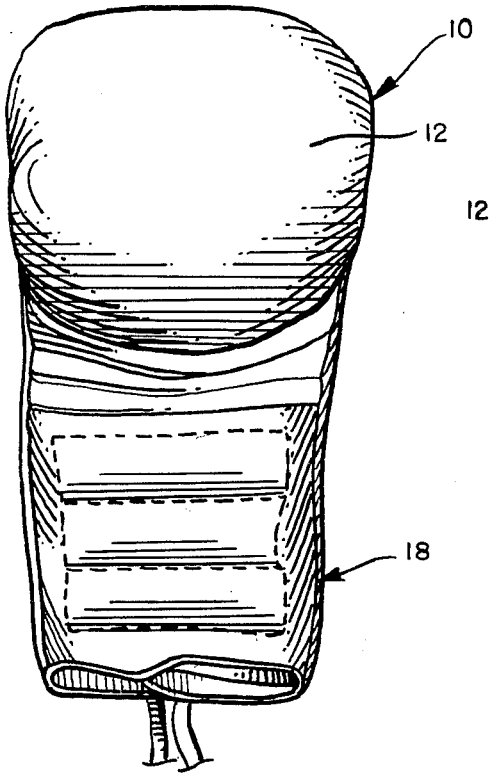
FIG. 1 is an elevational view of the padded backside of the boxing glove of the present invention.
Figure 2:
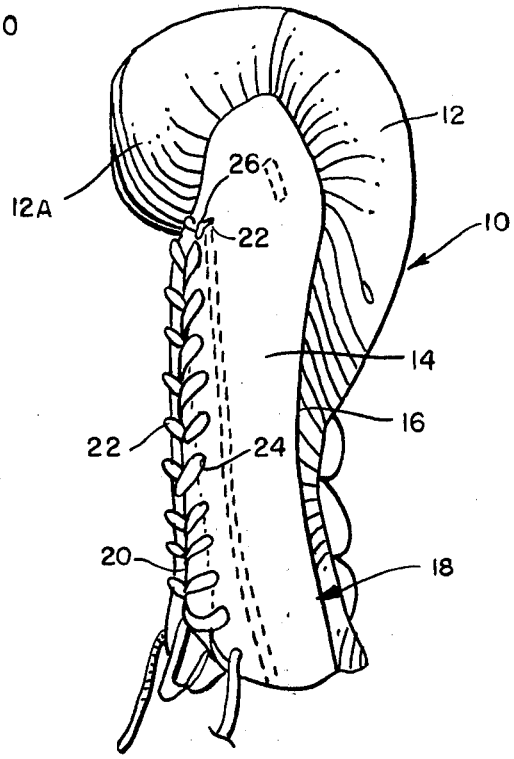
FIG. 2 is a side elevational view of the boxing glove.
Figure 3:
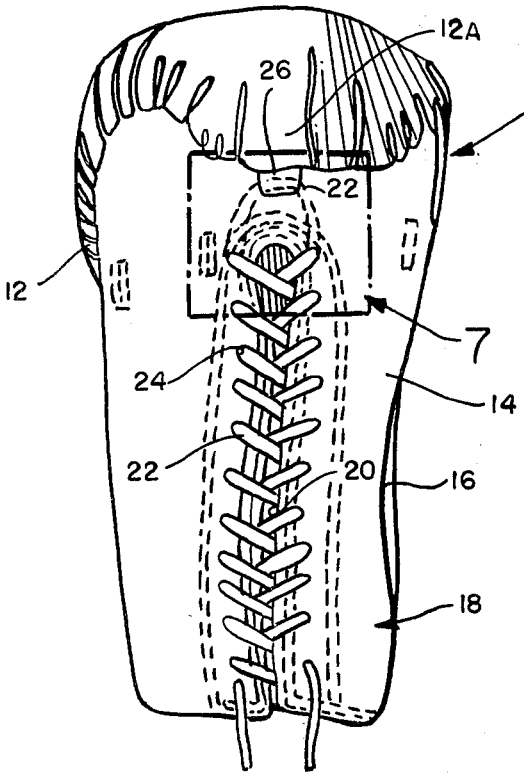
FIG. 3 is an elevational view of the palm side of the boxing glove.

Referring to the drawings in greater detail, and first to FIGS. 1-3, the present invention contemplates a thumbless boxing glove, generally designated 10, which includes a mitt section defined by a soft padded back portion 12 and a palm portion 14. The palm portion is joined to the soft padded back portion along a continuous seam line 16. As with conventional boxing gloves, the back and palm portions extend sufficiently to form a wrist portion which is generally designated 18. Of course, the padded back portion is reduced in thickness and size to form the integral wrist portion 16. At this point, it should be noted that the soft padded back portion curves around and beyond the end of the palm portion 14 and terminates in an inwardly projecting padded portion 12*a*.

In order to tighten the boxing glove about a boxer's hand, palm portion 14 is cut away to provide a longitudinally extending opening 20 which extends completely through the wrist portion 18 of the glove. Lacings 22 are threaded through eyelets 24 to connect the margins of opening 20 for tightening the glove about a boxer's hand.

An important feature of the invention is the provision of means for securing lacings 22 and to the inwardly projecting portion 12*a* of soft padded back portion 12 at a point beyond palm portion 14 to draw the back portion into a fist conformation upon tightening the lacings. More particularly, a loop 26 is secured on the outside of projecting portion 12*a*. Substantially the entire outer covering and inner lining of the boxing glove is fabricated of leather or like material. Loop 26 is fabricated of similar material and is secured to projecting portion 12*a* as by stitching. It can be seen that the loop is secured to the inwardly projecting padded portion 12*a* slightly beyond palm portion 14.

In order to minimize the amount of lacings 22 which are exposed in the palm of the glove, a pair of apertures 28 are formed through palm portion 14 beyond the end of cut away opening 22 and through which the lacings can pass from the inside of the glove for threading through loop 26. To this end, lacings 22 preferably comprise a single lace string connecting the margins of cut away opening 20, passing through apertures 28, and threaded through loop 26.

Figure 7:
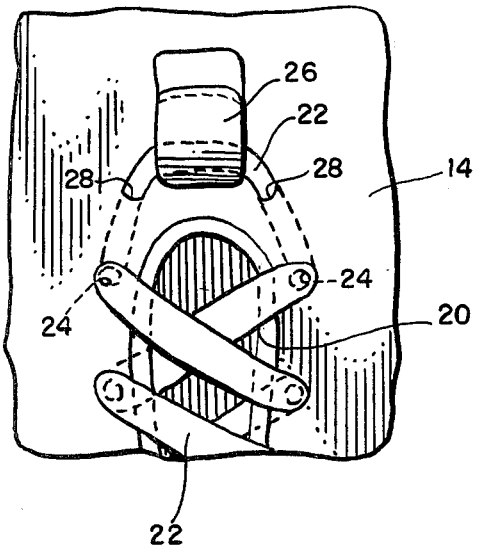
FIG. 7 is an enlarged view illustrating the means by which the lacings draw the padded back portion of the glove into a fist conformation.

It can be seen in FIG. 3 that cut away opening 20, loop 26 and apertures 28 are substantially in alignment for ease of drawing the glove into a fist conformation while tightening the lacings which bridge the margins of cut away opening 20. FIG. 7 is an enlarged view of the manner in which the lacings are threaded through apertures 28 and loop 26 beyond the end of cut away opening 20.

Another important feature of the invention is the provision of means within the boxing glove for restricting movement of a boxer's thumb to a position for proper clenching about the boxer's fist. More particularly, referring to FIGS. 4-6 and 9, the back and palm portions of the boxing glove define an inner cavity 30 for receiving the entire hand of a boxer. The inner cavity communicates with a longitudinal cavity or passageway 30*a* through wrist portion 18 of the glove. The thumb restricting means comprises a flexible strap 32 which has opposite ends secured to the inside of palm portion 14, as by stitching. It should be noted that the strap is located for engaging and embracing the boxer's thumb generally in the area of the inner or second joint thereof. This permits the thumb to have sufficient movement to enable the thumb to be positioned for proper clenching about the boxer's fist as shown in FIG. 6. Yet, the strap prevents the thumb, particularly in the area of the critical joints thereof, to be moved outwardly from the boxer's hand or fist which otherwise could cause dislocation and more serious injury to the thumb.

The boxing glove illustrated herein includes an elongated hand grip member 34 extending across the interior of inner cavity 30 generally parallel to a palm portion 14 in position to be substantially enclosed by a closed fist of the boxer, as seen in FIG. 6. The flexible thumb restricting strap 32 is positioned at one end of the hand grip member as shown best in FIG. 4. Consequently, the boxer's fingers can be gripped securely about the hand grip member, and then the thumb can be positioned for proper clenching about the boxer's remaining fingers, while the flexible strap prevents the thumb from being moved outwardly from that clenched position, thereby providing substantial protection for the thumb.

Figure 4:
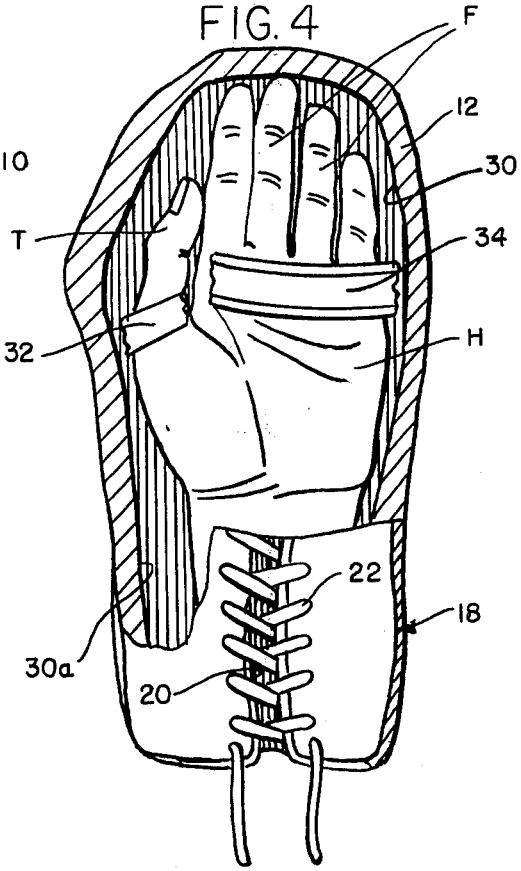
FIG. 4 is a sectional view through the boxing glove, with a boxer's hand initially inserted into the glove, illustrating the palm side of the hand.
Figure 5:
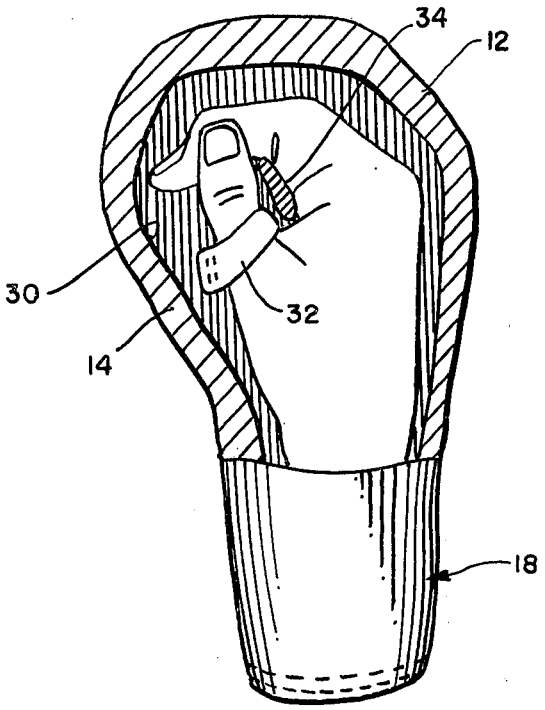
FIG. 5 is a sectional view through the boxing glove, illustrating the side of the boxer's hand being drawn toward a clenched fist.
Figure 6:
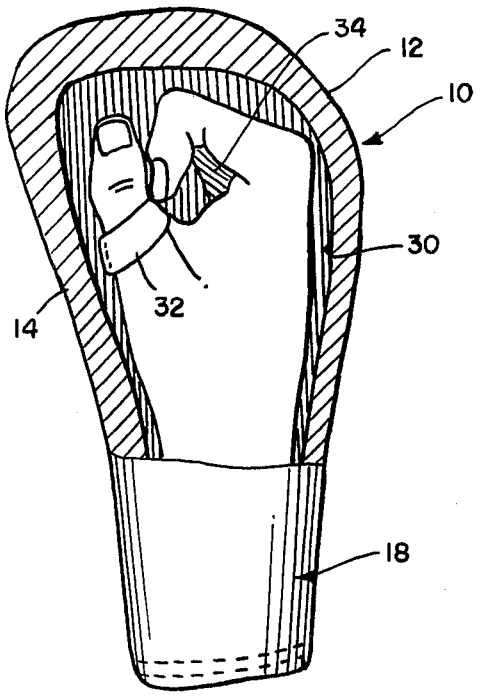
FIG. 6 is a view similar to that of FIG. 5, with the boxer's hand completely drawn into a clenched fist, with the boxing glove adjusting to such conformation.

FIGS. 4-6 show a boxer's hand H in sequential positions of insertion and clenching within the boxing glove of the present invention. FIG. 4 shows the hand first inserted in an extended position into the boxing glove, with thumb T extending through flexible strap 32 and the fingers F extending through and past hand grip member 34. FIG. 5 shows an intermediate position of the thumb and fingers as the boxer begins to close his hand into a fist. FIG. 6 shows the boxer's hand completely clenched into a fist conformation, with the fingers securely about hand grip member 34 and the thumb extending through strap 32 and positioned for proper clenching about the boxer's fist. Of course, the boxing glove itself, being substantially flexible, has assumed the conformation of the boxer's fist as shown in FIG. 6.

Figure 8:
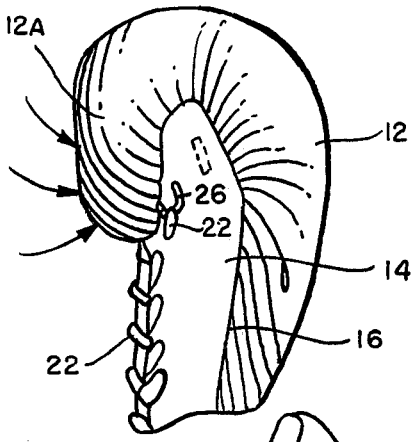
FIG. 8 is a view similar to that of FIG. 2, but with the boxing glove completely drawn into its fist conformation by the lacings.
Figure 9:
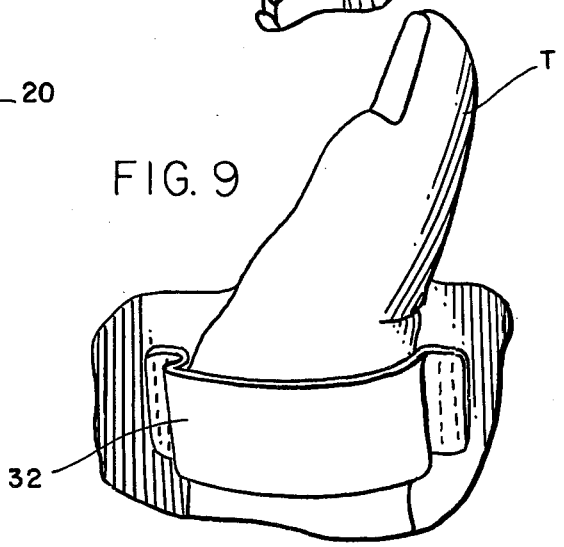
FIG. 9 is an enlarged view of the thumb movement restricting strap.

Once the boxer's hand has been inserted into the glove and clenched into a fist as shown in FIG. 6, lacings 22 are tightened not only to tighten the glove about the boxer's hand at the margins of cut away opening 20, but to draw the end of the boxing glove, at projecting padded portion 12*a*, into a tight fist conformation as shown in FIG. 8 and as described above.

Thus, it can be seen that a new and improved thumbless boxing glove has been provided which not only affords maximum protection for a boxer's thumb, but one in which the glove itself must be maintained in a tight fist conformation to prevent injury and unfair advantage of an opponent.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

What is claimed is:

1. In a thumbless boxing glove including a mitt section defined by a soft padded back portion and a palm portion, said back portion and palm portion defining an inner cavity for receiving the entire hand of a boxer, an elongated hand grip member extending across the interior of said inner cavity generally parallel to said palm portion in position to be substantially enclosed by a closed fist of the boxer, the improvement comprising a flexible strap having opposite ends secured to the inside of said inner cavity and sized to receive and surround the thumb of the boxer generally in the area of the inner joint of the thumb, said strip being positioned at one end of said hand grip member for restricting movement of the boxer's thumb to a position for proper clenching about the boxer's fist and preventing movement of the thumb outwardly from the boxer's hand or fist.

2. In a thumbless boxing glove as defined in claim 1, wherein the opposite ends of said strap are secured to the inside of said palm portion.

3. In a thumbless boxing glove as defined in claim 2, wherein opposite ends of said elongated hand grip member are secured to the inside of said palm portion.

4. In a boxing glove including a mitt section defined by a soft padded back portion and a palm portion, said back portion having a projecting portion at the juncture thereof with the palm portion, said palm portion being cut away to provide a longitudinally extending opening therein, a single lacing string bridging said cut away opening and connecting the margins thereof for tightening the glove about the boxer's hand, the improvement comprising means for engaging said lacing to said projecting portion of said soft padded back portion at at least one point beyond said palm portion to draw said back portion into a fist conformation automatically in response to tightening said lacing to tighten the glove about the boxer's hand.

5. In a boxing glove as defined in claim 4, wherein said last named means comprises a loop on the outside of said back portion for threading said lacing therethrough.

6. In a boxing glove as defined in claim 5, wherein said palm portion has at least one aperture therethrough beyond the end of said cut away opening through which said lacing can pass from the inside of said mitt section for threading through said loop.

7. In a boxing glove as defined in claim 6, wherein said single lacing string connecting the margins of said cut away opening passes through said aperture and is threaded through said loop.

8. In a boxing glove as defined in claim 4, wherein said palm portion has at least one aperture therethrough beyond the end of said cut away opening through which said lacings can pass from the inside of said mitt section for securing to said soft padded back section.

9. In a boxing glove including a mitt section defined by a soft padded back portion and a palm portion, said back portion and palm portion defining an inner cavity for receiving at least the fingers of a boxer, said back portion having a projecting portion at the juncture thereof with said palm portion, said palm portion being cut away to provide a longitudinally extending opening therein, a single lacing string bridging the cut away opening and connecting the margins thereof for tightening the glove about the boxer's hand, means for securing said lacing to said projecting portion of said soft padded back portion at at least one point beyond said palm portion to automatically draw said back portion into a fist conformation upon tightening said lacing, and aperture means through said palm portion beyond the end of said cut away opening through which said lacing can pass from said inner cavity for securing to said soft padded back section.

10. In a boxing glove as defined in claim 9, wherein said means for securing said lacing to said soft padded back portion comprises a single loop on the outside thereof.

11. In a boxing glove as defined in claim 10, wherein said aperture means comprise a pair of apertures on opposite sides of said loop.

12. In a boxing glove as defined in claim 11, wherein said loop and said apertures generally are in line with said longitudinally extending opening.

* * * * *